US006388393B1

(12) United States Patent
Illingworth

(10) Patent No.: US 6,388,393 B1
(45) Date of Patent: May 14, 2002

(54) BALLASTS FOR OPERATING LIGHT EMITTING DIODES IN AC CIRCUITS

(75) Inventor: Lewis Illingworth, Kensington, NH (US)

(73) Assignee: Avionic Instruments Inc., Avenel, NJ (US)

( * ) Notice: Subject to any disclaimer, the term of this patent is extended or adjusted under 35 U.S.C. 154(b) by 0 days.

(21) Appl. No.: 09/526,590

(22) Filed: Mar. 16, 2000

(51) Int. Cl.[7] ..... G05F 1/00
(52) U.S. Cl. ..... 315/291; 315/135; 362/800
(58) Field of Search ..... 315/200 A, 200 R, 315/185 R, 185 S, 209 R, 224, 291, 307, 135, 50–71, 360; 362/800, 240

(56) References Cited

U.S. PATENT DOCUMENTS 4,298,869 A * 11/1981 Okuno ..... 362/800
4,675,575 A * 6/1987 Smith et al. ..... 315/185 S
5,160,201 A * 11/1992 Wrobel ..... 362/800
6,020,688 A * 2/2000 Moisin ..... 315/209 R
6,040,663 A * 3/2000 Bucks et al. ..... 315/291
6,069,452 A * 5/2000 Rossner ..... 315/135
6,078,148 A * 6/2000 Hochstein ..... 315/291

* cited by examiner

*Primary Examiner*—Don Wong
*Assistant Examiner*—Wilson Lee
(74) *Attorney, Agent, or Firm*—Ward & Olivo

(57) ABSTRACT

Several types of ballast circuits for operating one or many LEDs in AC circuits finding particular use in aircraft lighting panels are disclosed. The first type is a linear transfer function ballast using inductors to limit diode current, and capacitors to ensure unity input power factors. The second type is a non-linear transfer function ballast using inductors to limit current, capacitors to ensure unity input power factor, and diodes shunted across one or many series connected inductors to steepen the transfer function. The aim of steepening the transfer function is to imitate the voltage—brightness characteristic of incandescent bulbs, thereby providing a direct replacement aerospace lighting solution compatible with existing AC light dimmers. It is also possible to configure the ballasts of the present invention to function with a DC input voltage.

11 Claims, 3 Drawing Sheets

BALLASTS FOR OPERATING LIGHT EMITTING DIODES IN AC CIRCUITS

TECHNICAL FIELD OF THE INVENTION

The present invention relates to ballast circuits for use with LEDs (light emitting diodes), and more specifically, to an improved dimmable ballast circuit for LEDs powered by AC (alternating current) finding particular use in aerospace lighting panels.

BACKGROUND OF THE INVENTION

Ballasts, in their most commonplace form, are used in conjunction with flourescent and other gas discharge light bulbs. A fluorescent lamp ballast is a device used to start and operate a fluorescent lamp and is a vital part of the lighting fixture. It provides the three-step action needed by a fluorescent lamp: controlled energy to heat the electrodes (filaments); the right voltage to start the arc; and impedance to limit the current to the proper value. To give optimal lighting performance, the ballast must supply the specific electrical values established by the fluorescent lamp manufacturer.

A further function of the ballast is to prevent the destruction of the lamp. Unlike an incandescent bulb or LED, if a fluorescent lamp were connected directly to AC power, it probably would not light. If it did light, the increase in current would soon destroy the lamp, since once the arc begins, the impedance of the lamp drops to a low value. Therefore, the ballast must provide additional impedance to limit current to the proper value. When improper electrical values are supplied by the ballast, the light output and life of the lamp may be greatly reduced.

The first common type of ballast is the electromagnetic ballast. Electromagnetic ballasts employ an inductor and a power capacitor. The inductor consists of a core of steel laminations surrounded by one, two or more copper or aluminum coils. The inductor provides the conditions for starting and controlling the current flow to the fluorescent lamp. Prior to the 1980's, the material chosen for the core and coils was usually driven by economics to minimize the ballast cost while meeting performance requirements. These ballasts are usually referred to as standard or conventional magnetic ballasts. Many of these ballasts are still in service today. During the 1980's more efficient designs started to gain some popularity. These designs, commonly referred to as energy efficient magnetic, are optimized for maximum efficiency. Since 1990, only energy efficient magnetic ballasts have met the U.S. efficiency regulations for most popular lamp configurations. This type of ballast is often enclosed in a metal case filled with an asphaltic compound that helps dissipate heat and control ballast sound.

Hybrid ballasts are an alternate design which start like rapid start ballasts but reduce or remove the electrode heating after the lamp is in full operation. Such ballasts are sometimes also referred to as cathode cutout ballasts. Some lamps have slightly reduced longevity when operated with these modified rapid start ballasts.

Employing more advanced technology, electronic ballasts operate lamps at high frequencies, using semiconductor components to change the frequency of the incoming AC power in combination with small inductive and/or capacitive components to provide the starting and regulating function. Electromagnetic ballasts operate the lamps at line frequency, usually 60 Hertz (Hz). Electronic ballasts convert the line frequency to frequencies between 20 and 60 kilohertz (kHz). It is well known in the art that low pressure arcs such those in fluorescent lamps are more efficient when operated at high frequencies. For many popular lamps, this increase in efficiency is about 10 percent. Furthermore, electronic construction weighs less than coil and core magnetic construction, allowing easier handling during installation, lower structural stress on ceiling supports and lower shipping costs.

Prior art avionics displays have utilized the aforementioned flourescent lighting and ballast technologies. Kalmanash U.S. Pat. No. 5,211,463 teaches a backlighting system for aircraft displays comprising distinct day viewing and night viewing configurations. The day viewing configuration may comprise a standard flourescent lamp and ballast for full color display while the night lighting system may comprise an additional lamp with appropriate infrared filtering for night vision compatibility. The system is not dimmable and is complex because of the additional ballast circuitry necessitated by the second lamp. Furthermore, because of the plurality of bulbs and ballasts, the cost of the system is high.

Fischer U.S. Pat. No. 5,296,783 discloses another flourescent lamp for use in aircraft displays. A flourescent lamp having dual filaments and dimming capabilities is taught. However, as is well known in the ballast art, a flourescent lamp may only be dimmed approximately 30 to 50 percent, and often at the cost of lamp efficiency and longevity. This is because at lower supply voltages the flourescent filament cannot heat to a temperature sufficient for thermionic emission and thus is undergoing thermal stress without producing light.

Alternatively, aircraft instrumentation lighting also widely utilizes incandescent lamps. Such lighting often produces high brightness and sunlight readability, both of which are very desirable features because aircraft are often at altitudes of 40,000 feet in daylight sun. However, since the lighting is produced by the heating of a lamp filament whose radiant emissions are primarily heat, reliability decreases. This ultimately leads to high failure rates and overall high maintenance rates throughout the service life of the aircraft.

LEDs, however, eliminate the problems inherent in incandescent lighting, i.e., high power consumption, high heat generation and high touch temperature (as per MIL-STD-1472). LEDs produce a brightness equivalent to incandescent bulbs while using only a third as much power. The reliability and high maintenance problems are eliminated by the use of highly reliable, long life LEDs. For example, with ballasts operating at 28 volts DC, tests done in accordance with MIL-HDBK-217F, Notice 2, reveal that an LED will last on average 85,000 hours whereas a typical incandescent lamp will last only 2,800 hours, i.e., the LEDs last over 30 times as long.

In view of the foregoing, the present invention addresses the shortcomings of the prior art by providing a dimmable LED ballast having high brightness, heightened reliability and efficiency, all while reducing cost.

SUMMARY OF THE INVENTION

The present invention relates to ballasts for LEDs finding particular use in aircraft lighting panels.

In a first embodiment, AC power is used to illuminate anti-parallel connected LEDs. A ballast inductor is used to limit current, while a capacitor is shunted across the input terminals to ensure a unity input power factor. This circuit is further modified by the addition of a transformer, thereby adapting the circuit for use with any input AC voltage. In this case, the shunt capacitor compensates for both the inductor and the magnetizing inductance of the transformer primary. Also, a circuit for use with a multitude of LEDs is taught that ensures equal brightness for all connected LEDs.

All of the foregoing circuits have a linear transfer characteristic, i.e., the LED current varies linearly with input AC voltage. This behavior is unsuitable because it does not emulate that of an incandescent bulb, and therefore these circuits are not compatible with conventional AC light dimmers. Thus, these circuits cannot readily take the place of an incandescent bulb in a pre-existing lighting panel. Therefore, alternate ballast embodiments are taught which use shunted diodes to short out one or several series connected inductors to steepen the slope of the transfer function, thereby more closely matching the behavior of incandescent bulbs.

Lastly, an embodiment is taught that accepts DC input and uses an oscillator circuit to convert the DC input to AC. Any of the above taught embodiments may be used along with the oscillator circuit.

Thus, it is an object of this invention to provide an LED ballast operable with a variety of AC voltages.

Further, it is an object of this invention to provide a dimmable LED ballast operable with a variety of AC voltages.

It is an additional object of this invention to provide a dimmable LED ballast capable of driving a multitude of LEDs with the same current.

It is yet another object of this invention to provide an AC powered dimmable LED ballast having a non-linear transfer characteristic.

Additionally, it is an object of this invention to provide a dimmable LED ballast having an oscillator to convert DC to AC.

Further, it is an object of this invention to provide a dimmable LED ballast that is a direct replacement for incandescent lighting.

It is yet another object of this invention to provide a dimmable LED ballast that does not produce any electrical interference.

It is a further object of this invention to provide a dimmable LED lighting system finding particular use in aerospace applications that is night vision compatible.

Furthermore, it is an object of this invention to provide a dimmable LED ballast using only passive components.

BRIEF DESCRIPTION OF THE DRAWINGS

The present invention is best understood with reference to the detailed description below, which is intended to be read in conjunction with the set of drawings, wherein.

DETAILED DESCRIPTION OF THE PREFERRED EMBODIMENTS

Figure 1:
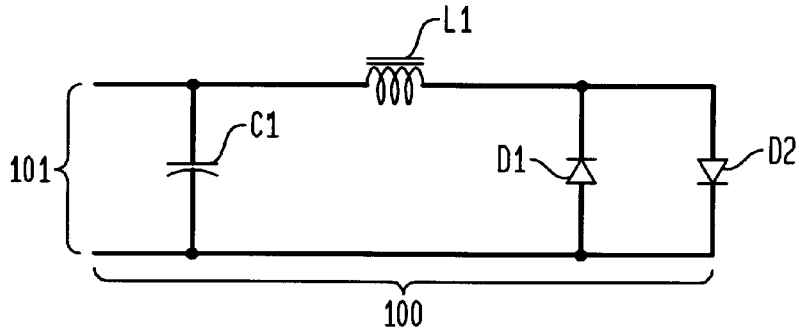
FIG. 1 is a schematic diagram of light emitting diodes with an inductor ballast.

The invention currently disclosed will now be described with reference to the drawings wherein FIG. 1 schematically depicts a first embodiment of a dimmable AC powered LED ballast 100 in accordance with the present disclosure. Input terminals 101 accept AC voltage. Two light emitting diodes D1 and D2 are connected anti-parallel with a ballast inductor L1. On negative half cycles D1 conducts with D2 reversed biased; on positive half cycles D2 conducts with D1 reverse biased. For input voltages greater than one and a half times the LED forward threshold voltage the circuit current is approximately:

$$[VIN, RMS-(0.5*\text{forward threshold voltage})]/(2*\Pi*f*L)$$

where f is the operating frequency and L is the inductance of L1.

The circuit L1, D1, D2 is predominantly inductive with a lagging power factor. This can be corrected by adding capacitor C whose value is computed by:

$$[1/(2*\pi*f*c)]=2*\pi*f*L$$

where C is the capacitance of C1 and F and L are the operating frequency and inductance of L1, respectively. The addition of the capacitor C1 ensures unity input power factor.

Figure 2:
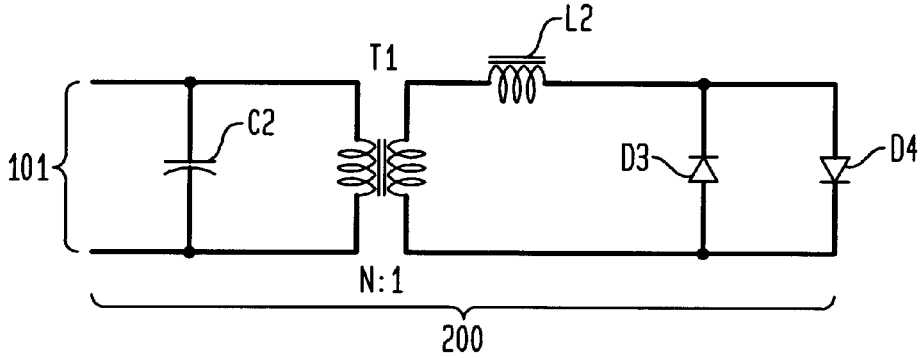
FIG. 2 is a schematic diagram of light emitting diodes with an inductor ballast further utilizing an input transformer.

FIG. 2 depicts an alternate embodiment 200 very similar to the circuit depicted in FIG. 1, but is modified to accept a range of AC input voltages at terminals 101. Transformer T1 may use any winding ratio to accommodate the incoming AC voltage at terminals 101. Capacitor C1 is moved to the transformer primary to compensate for both L2 inductance and T1 primary magnetizing inductance. D3 will conduct during the negative half cycles whereas D4 will conduct during the positive half cycles.

Figure 3:
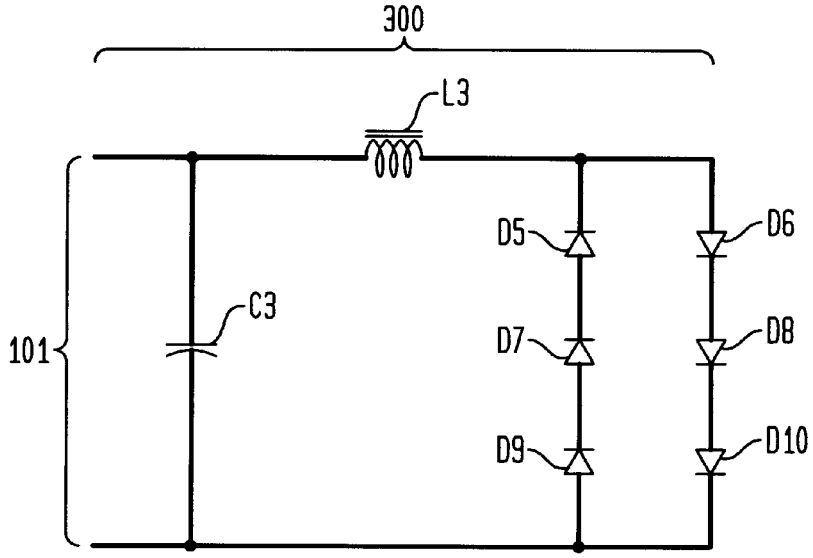
FIG. 3 is a schematic diagram of series—parallel connected light emitting diodes in an inductor ballast.

FIG. 3 depicts a circuit 300 wherein multiple LEDs are used for greater brightness or for illuminating a large area. In this circuit the LEDs are wired series—parallel. D5, D7 and D9 are series with respect to each other while parallel with respect to series connected D6, D8 and D10. This arrangement increases the voltage required by the circuit and has the advantage of ensuring equal current flow, and therefore equal brightness, through all LEDs. D5, D7 and D9 conduct during negative half cycles whereas D6, D8 and D10 conduct during positive half cycles.

Figure 4:
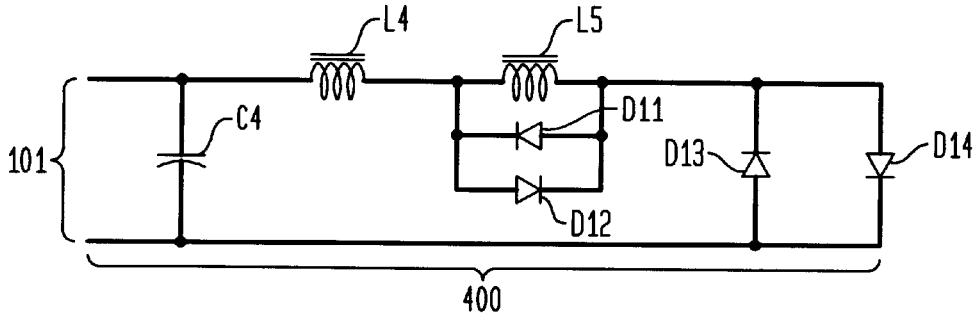
FIG. 4 is a schematic diagram of light emitting diodes with an inductor ballast having a non-linear transfer characteristic.

FIG. 4 depicts a ballast circuit 400 having non-linear transfer characteristics in accordance with the present invention. In this circuit the currents through LEDs D13 and D14 are not proportional to the input voltage but are made to increase more rapidly as the input voltage is increased. Circuit 400 has an additional inductor L5 that has two anti-parallel diodes D11 and D12 shunted across it. When the input AC voltage at terminals 101 is low, the voltage across D11 and D12 is below the conduction threshold and D13 and D14 currents are determined by L4 and L5 in series. With increasing input voltages, D11 and D12 conduct and effectively short out L5. The currents through D13 and D14 are now controlled by L4 alone.

Figure 5:
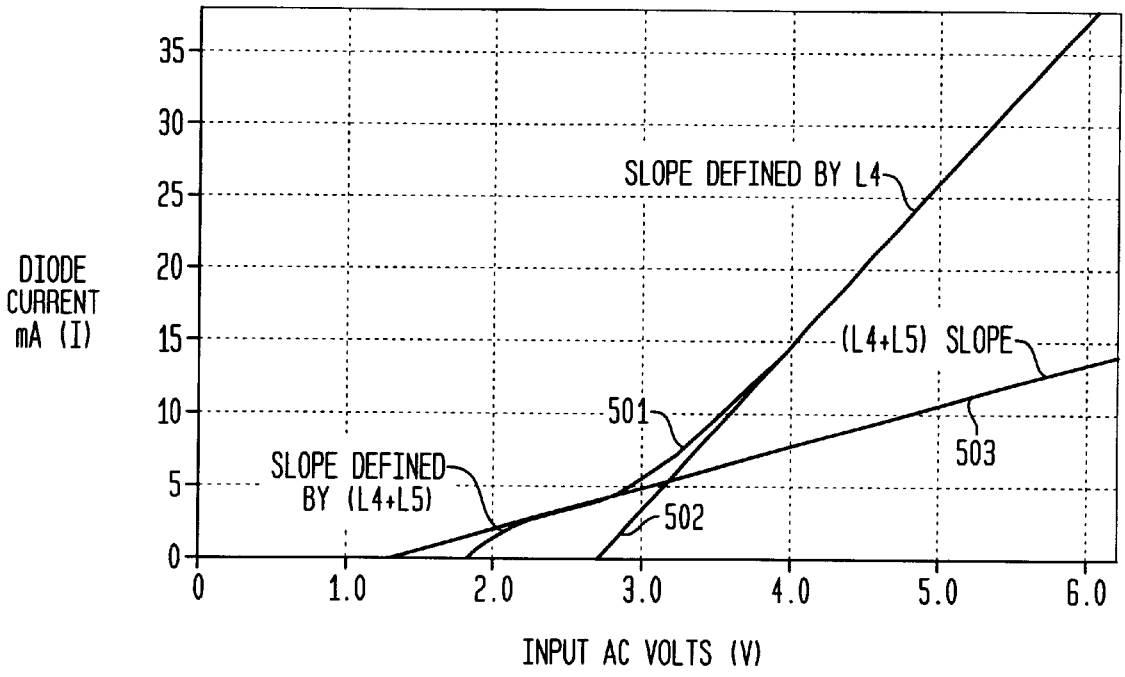
FIG. 5 depicts the non-linear transfer characteristic of the ballast circuit depicted in FIG. 4.

The resulting transfer characteristic of circuit 400 is shown graphically in FIG. 5. Diode current (I), in milliamps, is plotted on the Y axis and input AC voltage (V), in volts, is plotted on the X axis. Line 502 illustrates the transfer characteristic when the diodes D13 and D14 are connected singly with inductor L4. The slope (dI/dV) is rather steep. Line 503 illustrates the transfer characteristic when the diodes D13 and D14 are connected to both inductors L4 and L5. The slope in this case is gradual. The combined transfer characteristic is illustrated by line 501. Prior to the diode D11 and D12 conduction point, the slope of line 501 takes on the slope of line 503. After the D11 and D12 conduction point, L5 is shorted out leaving only L4 connected. At that point, the transfer characteristic 501 takes on the slope of line 502. Adding more inductor-diode sections adds additional points of non-linear behavior similar to what occurs at approximately 2.8 volts. Adding such additional non-linear behavior is necessary for the LED brightness to vary with input voltage in the same manner that an incandescent lamp brightness varies with voltage.

Figure 6:
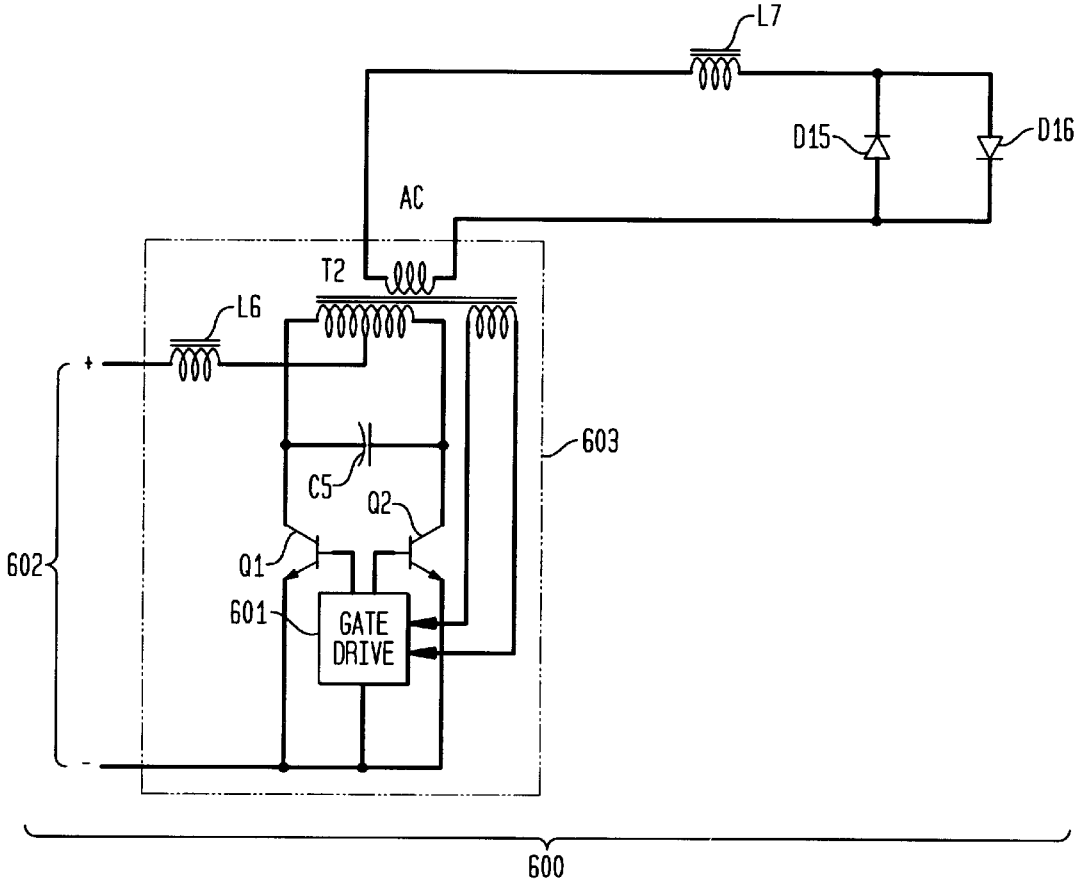
FIG. 6 depicts an inductor ballast driven by a current fed parallel resonant oscillator for use with DC power sources.

While the invention disclosed is meant primarily for use with AC power, the circuitry can be readily adapted to DC operation by replacing transformer T1 in circuit 200 of FIG. 2 with an oscillator. Many ballast circuits for flourescent and gas discharge lamps use an oscillator as depicted in circuit 600 of FIG. 6. This oscillation circuit 603, known as a current fed parallel resonant oscillator is well known in the art and thus does not merit descriptive detail. Briefly, transistors Q1 and Q2 are the active elements driven by gate drive 601 in oscillator 603 having a tuned circuit transformer T2 primary and capacitor C5. The circuit 603 is fed by a constant current through inductor L6. The secondary winding of T2 has a sinusoidal output at the resonant frequency with voltage proportional to the DC input at terminals 602. The use of such an oscillator allows the frequency to be raised above the 60 Hz commercial line or 400 Hz aircraft supply to a higher range. This permits the physical size of the magnetic components to be reduced. Ballast inductor L7 and LEDs D15 and D16 operate in the same manner as earlier disclosed. Ballast inductor L7 limits current through LEDs D15 and D16 with D1 conducting during the negative half cycles and D16 conducting during the positive half cycles. This circuit may also utilize the earlier disclosed non-linear transfer function ballast 400.

All of the above embodiments, in their final form, are preferably implemented as direct replacement solutions for existing incandescent aerospace lighting systems.

While the present invention has been described with reference to one or more preferred embodiments, which embodiments have been set forth in considerable detail for the purposes of making a complete disclosure of the invention, such embodiments are merely exemplary and are not intended to be limiting or represent an exhaustive enumeration of all aspects of the invention. The scope of the invention, therefore, shall be defined solely by the following claims. Further, it will be apparent to those of skill in the art that numerous changes may be made in such details without departing from the spirit and the principles of the invention.

I claim:

1. A ballast for operating diodes, comprising:

AC input means, for receiving AC voltage;

capacitor means, aligned parallel to said AC input means;

inductor means, coupled to said capacitor means, aligned serial to said AC input means;

secondary inductor means, aligned serial to said inductor means;

a plurality of anti-parallel shunt diodes shunted across said secondary inductor;

a plurality of diodes coupled to said secondary inductor means, aligned anti-parallel to each other, and further aligned parallel to said AC input means; and a transformer comprising primary and secondary coils, said primary coils coupled to said capacitor means.

2. A ballast according to claim 1, wherein said transformer is of the isolation type.

3. A ballast according to claim 1, wherein said transformer is of the step-up type.

4. A ballast according to claim 1, wherein said transformer is of the step-down type.

5. A ballast according to claim 1, wherein said diodes coupled to said secondary inductor are of the light emitting type.

6. A ballast for operating diodes, comprising:

AC input means, for receiving AC voltage;

capacitor means, aligned parallel to said AC input means;

inductor means, coupled to said capacitor means, aligned serial to said AC input means;

secondary inductor means, aligned serial to said inductor means;

a plurality of anti-parallel shunt diodes shunted across said secondary inductor;

a plurality of diodes coupled to said secondary inductor means, aligned anti-parallel to each other, and further aligned parallel to said AC input means; and dimmer means couple to said AC input means to vary said AC voltage;

wherein when said AC voltage through said secondary inductor means exceeds the conduction threshold of said plurality of anti-parallel shunt diodes, said secondary inductor means are shunted.

7. A method of controlling current to a plurality of diodes, comprising the steps of:

receiving AC voltage, said AC voltage having an AC voltage amplitude;

limiting current delivered from said AC voltage into said plurality of diodes wherein said limiting is inversely related to said AC voltage amplitude, wherein said step of limiting current comprises:

providing a primary current limiter;

providing a secondary current limiter, said secondary current limiter responsive to said AC voltage amplitude; and bypassing said secondary current limiter when said AC voltage amplitude exceeds a pre-determined value.

8. A method according to claim 7, wherein said plurality of diodes are of the light-emitting type.

9. A method according to claim 7, further comprising the step of varying said AC voltage amplitude.

10. A method according to claim 7, wherein said step of receiving comprises:

receiving DC voltage;

converting said DC voltage to AC voltage.

11. A ballast according to claim 6, wherein said diodes coupled to said secondary inductor are of the light-emitting type.

* * * * *